US005724873A

United States Patent [19]

Hillinger

[11] Patent Number: 5,724,873

[45] Date of Patent: Mar. 10, 1998

[54] COMPOSITE MAGNETIC-FIELD SCREWDRIVER

[76] Inventor: George Hillinger, 129 N. LeDoux Rd., Beverly Hills, Calif. 90211

[21] Appl. No.: 679,236

[22] Filed: Jul. 12, 1996

[51] Int. Cl.[6] ..... B25B 23/12

[52] U.S. Cl. ..... 81/451; 81/125; 81/438

[58] Field of Search ..... 81/125, 451, 438

[56] References Cited

U.S. PATENT DOCUMENTS

| | | | |
|---|---|---|---|
| 2,838,082 | 6/1958 | Lange | 81/438 |
| 3,007,504 | 11/1961 | Clark | 81/125 |
| 5,012,708 | 5/1991 | Martindell | 81/438 |

*Primary Examiner*—Timothy V. Eley
*Assistant Examiner*—Lee Wilson
*Attorney, Agent, or Firm*—Albert O. Cota

[57] ABSTRACT

A composite magnetic-field screwdriver (10) that consists of two elements: a non magnetic-conductive housing (12) and a selectable, magnetic-conductive tool bit (100). The housing (12) includes a tool bit cavity (80) that accepts the tool bit (100) and a drill-chuck connector sleeve (48) into which is frictionally inserted a non magnetic-conductive drill chuck connector (88). The housing (12) includes an upper ring magnet (60) and a lower circular magnet (84). The two magnets operate in combination to produce a composite magnetic flux path. The composite magnetic flux path is activated only when a workpiece (250) is attached to a tool bit (100) that has been inserted into the tool bit cavity (80). The composite magnetic flux path results in a high-level gauss at the bit's upper section which allows the workpiece i.e., a screw to be firmly attached to the tool bit (100). In a second embodiment, a magnetic housing (150) is utilized that is designed to contain a single concentric dual magnet (174) in lieu of the two magnets of the preferred embodiment. The dual magnet (174) also produces a composite magnetic flux path that functions in a similar manner as described for the preferred embodiment.

17 Claims, 4 Drawing Sheets

COMPOSITE MAGNETIC-FIELD SCREWDRIVER

TECHNICAL FIELD

The invention pertains to the general field of magnetic screwdrivers. More particularly, the invention pertains to a magnetic screwdriver that produces a composite magnetic flux path that allows a high-level gauss to be applied to a workpiece attached to the screwdriver.

BACKGROUND ART

Manual screwdrivers, as well as electrical and pneumatic drills have tool tips attached which are universally utilized to insert and remove screws and the like through and from various types of materials. To perform this task, it is necessary to position and maintain, with one hand, the screw in a firm and generally perpendicular direction with respect to the surface of the material. The other hand is then utilized to rotate the manual screwdriver handle or to activate the electric or pneumatic drill after the tool bit tip has been inserted into the screw head opening.

In most situations, the depth of the screw head opening is relatively shallow. Thus, in many cases it is difficult to maintain contact between the screw head opening and the tip of the screwdriver or tool bit. Any slippage of this contact can cause:

- lost work time due to time lost to reinsert the screwdriver's tip or tool tip back into a screw slot,
- damage to the tool blade and/or edges of the screw slot due to tool slippage,
- injury to the hand holding the screw, and
- damage to surrounding machinery or loss of a screw if the screw is displaced and falls due to a slippage of a screwdriver tip or tool bit.

Prior art screwdrivers have attempted to solve the above problems by:

a) mechanical means which places the screw in a sleeve into which, the screwdriver blade extends inward to interface with the screw slot. The sleeve must be sized to fit a specific screw size.

b) mechanical means which places the screw between two or three blades of spring-like materials until the screwdriver blade interfaces with the screw. In this method, the size of screw heads that may be used is limited. In the above cases, the basic inconvenience is that the sleeve as well as the spring are designed to fit specific head dimensions. Thus the universality of the tool is limited.

c) magnetic means that holds the screw on the screwdriver blade. Because of the relatively small area available to house a magnet, the gauss level of the magnet is relatively weak and generally insufficient to adequately hold a screw in place. Therefore, the second hand must be used to also hold the screw.

A search of the prior art did not disclose any patents that read directly on the claims of the instant invention. However the following U.S. Pat. Nos. are considered related:

| U.S. Pat. No. | INVENTOR | ISSUED |
|---|---|---|
| 3,392,767 | Stillwagon, Jr. | 16 July 1968 |
| 3,007,504 | Clark | 7 November 1961 |
| 2,838,082 | Lange | 10 June 1958 |
| 2,260,055 | Reardon | 21 October 1941 |

The U.S. Pat. No. 3,392,767 Stillwater, Jr. patent discloses a permanent magnet driver for driving threaded fasteners such as screws and nuts. The driver includes an annular band of magnetized rubber bonded barium ferrite disposed within or in surrounding relation to the driver. A portion of the driver forms one of the magnetic pole pieces and utilizes an annular sleeve, which surrounds the rubberized magnetic material, as the opposite pole piece.

The U.S. Pat No. 5,007,504 Clark patent discloses a magnetic tool that is adapted to interchangeably receive a plurality of tool bits, sockets and the like. The tool is designed to drive screws and similar fasteners that are held in magnetic contact with the tool.

The U.S. Pat. No. 2,858,082 Lange patent discloses a magnetic driving tool which incorporates a permanent magnet and a tool bit. The tool includes a main body provided with a shank for driving and which encloses the permanent magnet. The body also supports the bit in a direct magnetic flux transmitting relation with the magnet, allowing the tool to attract screws or other fasteners that are to be driven by the tool bit.

The U.S. Pat. 2,260,055 Reardon patent discloses a magnetic tool having a bead portion with a recess into which is inserted a permanent magnet. The magnet has one of its polar faces extending toward the open end of the recess to thus form a seat for magnetically holding a driving member. The magnet is further provided with a transverse slot for positioning a tool bit.

For background purposes and as indicative of the art to which the invention relates, reference may be made to the following remaining patents found in the search:

| U.S. Pat. No. | INVENTOR | ISSUED |
|---|---|---|
| 1,377,958 | Andrews | 10 May 1921 |
| 2,677,294 | Clark | 4 May 1954 |
| 2,714,829 | Clark | 9 August 1955 |
| 2,718,806 | Clark | 27 September 1955 |
| 2,806,396 | Miller | 17 September 1957 |
| 2,864,417 | Scholten | 16 December 1958 |
| 3,731,722 | Carr | 8 May 1973 |

A review of the prior art patents did not disclose any patents that utilized a similar structural housing or tool bit as disclosed in the instant invention. Additionally, the prior art did not disclose any magnetic screwdrivers that employed two permanent magnets or a single, concentric dual ring magnet that function to produce a composite magnetic flux path. This composite flux path allows a high-level gauss to be channeled through magnetic-conductive materials and applied to the tip of the tool bit and the attached workpiece.

DISCLOSURE OF THE INVENTION

The disclosed invention is designed to provide a magnetic screwdriver having a housing that accepts a variety of tool bits. The housing, which is configured to fit into a standard drill chuck or a hand-held screwdriver, features a magnetic circuit that produce two magnetic flux paths. In the preferred embodiment two permanent magnets are used, while in a second embodiment, a single concentric dual ring magnet is used to produce the two magnetic flux paths. The two flux paths combine to produce a composite flux path that results a high-level gauss that is applied to a workpiece, such as a screw, when the workpiece is attached to the upper end of the tool bit. Prior to the attachment of the workpiece, which functions as a "magnetic connector", the composite flux path is inactive.

In its most generic design, the composite magnetic-field screwdriver is comprised of a housing and a magnetic-conductive tool bit. The housing includes an upper sleeve into which is slidably inserted the tool bit, a lower sleeve into which is frictionally inserted a drill chuck connector or screwdriver shaft, and at least one magnet located within said housing. The at least one magnet has means for producing a composite magnetic flux path that is activated when said tool bit is inserted into the upper sleeve and a workpiece is attached to the tool bit. The composite magnetic flux path results in a high-level gauss that firmly holds the workpiece to the tool bit.

In its most basic preferred design, the composite magnetic-field screwdriver consists of the following:

A. a non magnetic-conductive housing having:
   1. an upper sleeve, a lower magnet sleeve and a drill-chuck connector sleeve. The upper sleeve has an integral lower section that has a polygon shape,
   2. an upper ring magnet frictionally inserted into the upper sleeve,
   3. an upper non magnetic-conductive sleeve inserted into the upper ring magnet. The area inward from the non magnetic-conductive sleeve forms a drill bit cavity which continues downward into the polygon section of the upper sleeve,
   4. a circular magnet frictionally inserted into the lower magnet sleeve,
   5. a non magnetic-conductive drill chuck connector frictionally inserted into the drill-chuck connector sleeve, and B. a magnetic-conductive tool bit having a lower section dimensioned to slidably fit into the polygon shaped drill bit cavity. The tool bit includes a magnetic-conductive tool bit gripping disc that functions in combination with a workpiece as the "magnetic connector" when the workpiece is attached to the tool bit, and the tool bit is inserted into the housing.

To increase the life of the invention all the non magnetic-conductive elements, such as the housing, are made of a non-conductive material such as stainless steel. Likewise, the magnetic-conductive elements, such as the tool bit gripping disc are made of a magnetic-conductive material such as stainless steel. The polygon shape of the upper sleeve's lower section, the drill-chuck connector, and the lower section of the bit body are preferably in a hexagon configuration. The ring and the circular permanent magnets are preferably Samarium Cobalt or Neodimium magnets. However, any equivalent-power magnet can be utilized.

In view of the above disclosure, it is the primary object of the invention to provide a magnetic screwdriver that utilizes two permanent magnets. The magnetic flux paths of the two magnets combine to produce a composite magnetic flux path that is channeled through magnetic-conductive materials and applied to a workpiece attached to the tool bit.

In addition to the primary object of the invention it is also an object to produce a magnetic screwdriver that:

can be designed to accommodate various sizes of drill chucks and manual screwdrivers, can accept various configurations of tool bits, is maintenance free, utilizes a novel structural design which makes possible the use of high gauss magnets, can be adapted for either manual or machine operation, permits the flux of the two permanent magnets to be utilized in the most effective manner, protects the two permanent magnets from the deleterious effects of dropping the screwdriver on hard surfaces, is compact, of simple and rugged construction, of long useful life and which may be manufactured and assembled in an economical manner.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 2:
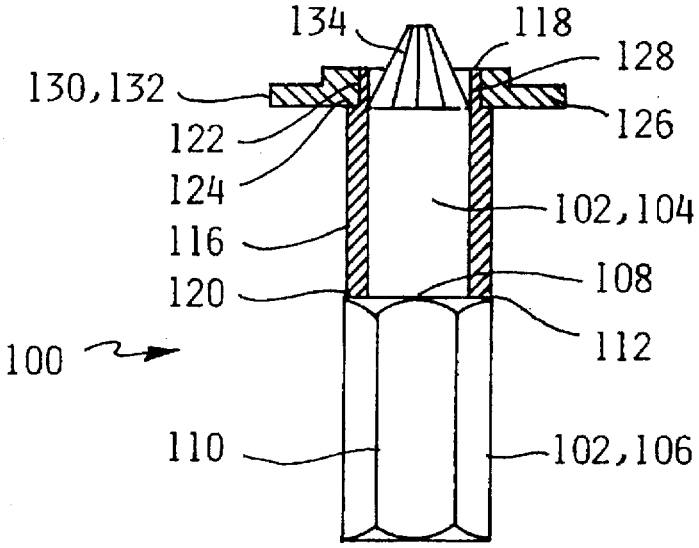
FIG. 2 is an elevational-sectional view of the magnetic-conductive tool bit and its associated elements.

The best mode for carrying out the composite magnetic-field screwdriver is presented in terms of a preferred embodiment and a second embodiment. Both embodiments employ a composite magnetic circuit that applies a maximum gauss level to a workpiece such as a screw, that is attached to a tool bit inserted into a housing of the invention.

The preferred embodiment of the composite magnetic-field screwdriver 10, as shown in FIGS. 1–6, is comprised of two major elements: a non magnetic-conductive housing 12 and a magnetic-conductive tool bit 100. The housing includes an upper, non magnetic-conductive sleeve 70, a non magnetic-conductive drill chuck connector 88 and two permanent magnets: a ring magnet 60 and a circular magnet 84.

Figure 3:
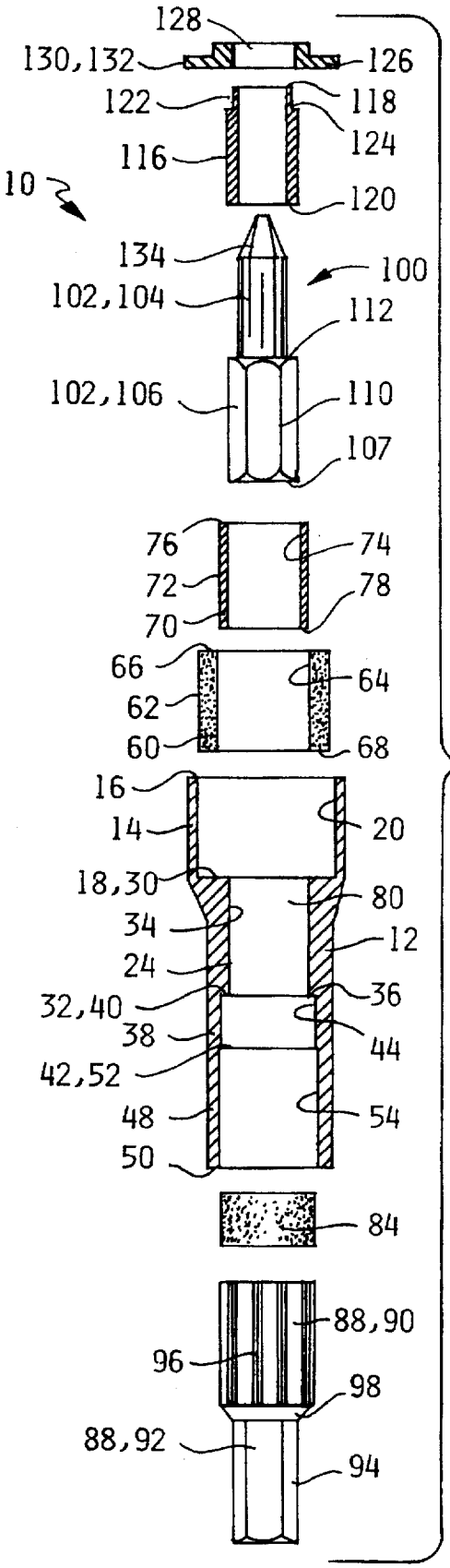
FIG. 3 is an elevational-exploded view of the composite magnetic-field screwdriver.

The housing 12, as best shown in the exploded view of FIG. 3, is made of a non magnetic-conductive material such as stainless steel and includes four integral sleeves: an upper sleeve 14, a polygon sleeve 24, a lower magnet sleeve 38 and a drill chuck connector sleeve 48.

Figure 4:
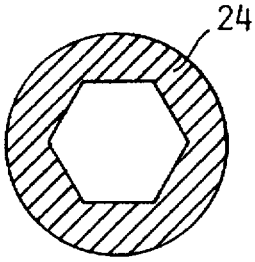
FIG. 4 is a sectional view taken along the lines 4—4 of FIG. 1 showing a polygon sleeve configured in a hexagon shape.

The upper sleeve 14 has an upper edge 16, a lower terminus 18 and an inner surface 20. The polygon sleeve 24, as the name implies, is in a polygon shape that preferably consists of a hexagon as shown in FIG. 4. However, other polygons such as a square or an octagon (not shown) may also be used. The polygon sleeve 24, has an upper terminus 30, a lower terminus 32, and an inner surface 34. The upper terminus 30 interfaces with the lower terminus 18 of the upper sleeve 16, and the inner surface 34 extends inwards from the vertical plane of the inner surface 20 of the upper sleeve that terminates in a magnet/sleeve ledge 36.

The lower magnet sleeve 38 includes an upper terminus 40, a lower terminus 42 and an infer surface 44. The upper terminus 40 interfaces with the lower terminus 32 of the polygon sleeve 24 and the inner surface 42 extend outward from the vertical plane of the inner surface 34 of the polygon sleeve 24.

The drill chuck connector sleeve 48 has a lower edge 50, an upper terminus 52 and an inner surface 54. The upper terminus 52 interfaces with the lower terminus 42 of the lower magnet sleeve 58. The inner surface 54 extends outward from the vertical plane of the inner surface 44 of the lower magnet sleeve 38.

The preferred embodiment of the invention features two permanent magnets, the ring magnet 60 and the circular magnet 84. The two magnets function in combination, to provide a high-level gauss to the workpiece, when the workpiece is attached to the tip of the tool bit 100 as described infra.

Figure 1:
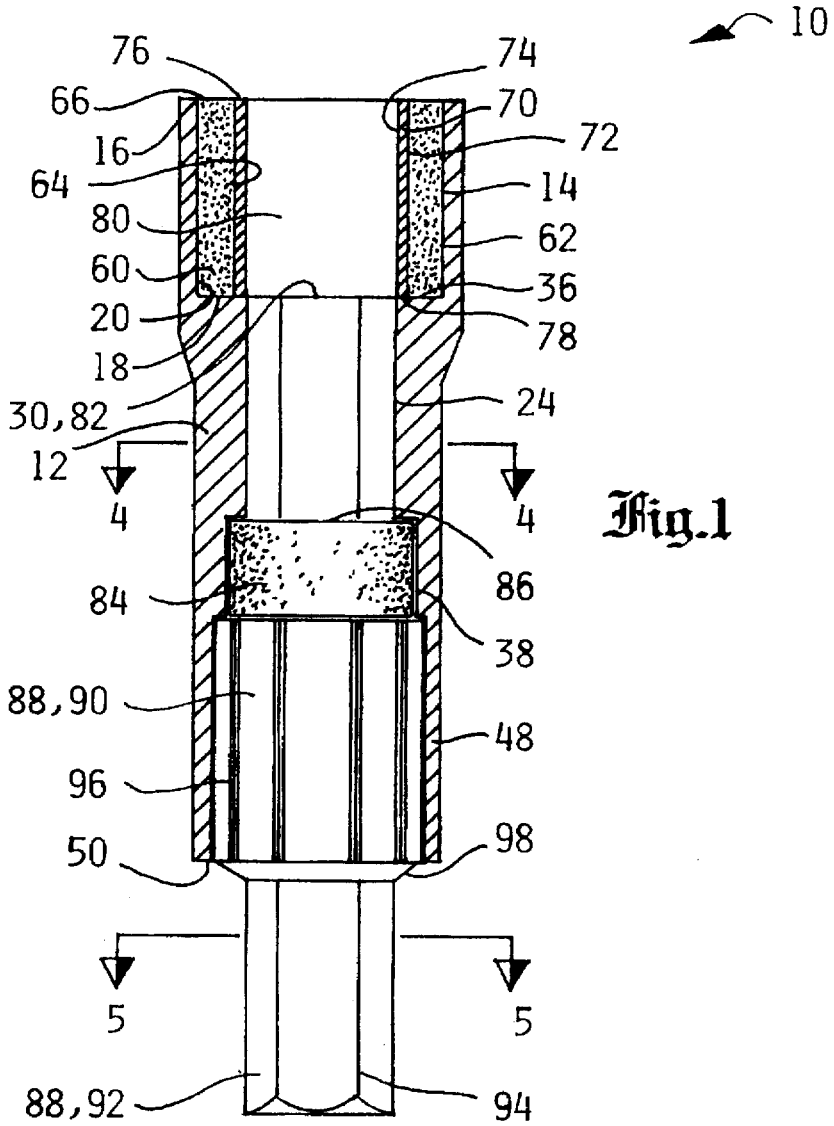
FIG. 1 is an elevational-sectional view of the non magnetic-conductive housing and its associated elements.

The ring magnet 60, as shown inserted into the housing 12 in FIG. 1, and separated in the exploded view of FIG. 3, has an outer surface 62, an inner surface 64, an upper surface 66 and a lower surface 68. The ring magnet 60 is frictionally inserted into the upper sleeve 14 with the magnet's outer surface 62 interfacing with the inner surface 20 of the sleeve 14. The upper surface 66 when inserted, as shown in FIG. 1, is in horizontal alignment with the upper edge 16 of the upper sleeve 14, and the lower surface 68 rests upon the magnetic/sleeve ledge 36.

The ring magnet 60 is held in place and insulated by the upper non magnetic-conductive sleeve 70 which includes an outer surface 72, an inner surface 74, an upper edge 76 and a lower edge 78. As shown best in FIG. 3, the sleeve 70 is frictionally inserted into the ring magnet 60 with the outer surface 72 interfacing with the inner surface 64 of the ring magnet 60. When the sleeve 70 is inserted, the upper edge 76 is in horizontal alignment with the upper edge 66 of the ring magnet 60, as shown in FIG. 1, and the lower edge 78 rests on the magnet/sleeve ledge 36. Between the sleeve's 70 inner surface 74 is formed a tool bit cavity 80 that has a lower terminus 82 which interfaces with the upper terminus 30 of the polygon sleeve 24. In lieu of the sleeve 70, a non magnetic-conductive coating (not shown) may be applied to the inner surface 64 of the ring magnet 60.

The second magnet in the design of the composite magnetic-field screwdriver 10 is the circular magnet 84. This magnet is dimensioned to frictionally fit into and within the confines of the lower magnet sleeve 38 as shown in FIG. 1. Both the ring magnet 60 and circular magnet 84 are comprised of a high magnetic-power material such as Samarium Cobalt or Neodimium.

Figure 5:
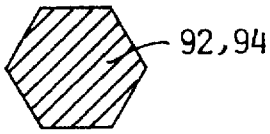
FIG. 5 is a partial sectional view, taken along the lines 5—5 of FIG. 1, showing the lower section of the drill chuck connector configured in a hexagon shape.

The final element of the housing 12 is the non magnetic-conductive drill-chuck connector 88. This connector includes an upper section 90 and a lower section 92. The upper section 90, as shown in FIG. 1, is dimensioned to frictionally fit into and within the confines of the drill-chuck connector sleeve 48. Preferably, the upper section 90 includes a plurality of serrations 96 as also shown in FIG. 1. The lower section 92 has a polygon shape 94 that extends outward from the lower edge 90 of the drill-chuck connector sleeve 48. Preferably the polygon shape is in a hexagon shape 94 as shown in FIG. 5. Also, to add structural integrity to the interface between the upper section 90 and lower section 92, a reinforcing chamfer 98 is included as shown in FIG. 1.

Prior to inserting the drill-chuck connector 88, the ring magnet 60 and the circular magnet 84, an adhesive (not shown) may be applied to the contact surfaces. The adhesive aids in maintaining the structural integrity of the two respective interfacing elements.

The final element that comprises the composite magnetic-field screwdriver 10 is the tool bit 100 as shown assembled in FIG. 2 and in an exploded view in FIG. 3. The tool bit 100 includes a magnetic-conductive bit body 102, a non magnetic-conductive sleeve 116, and a magnetic-conductive tool-bit gripping disc 126. The body 102 has an upper section 104 integral with a lower section 106 further having a lower surface 107. The lower section 106 includes an upper terminus 108 having a polygon shape 110 dimensioned to slidably fit into the polygon sleeve 24 of the inventive screwdriver 10. The upper section 104 is round and has a diameter that is slidably less than the dimension of the polygon shaped lower section 106. This configuration allows a ledge 112 to be formed around the upper edge of the upper terminus 108, as shown best in FIG. 3.

The non magnetic-conductive sleeve 116 includes an upper edge 118, a lower edge 120, an upper section 122 and a ledge 124. The sleeve 116 has an inside diameter that is dimensioned to frictionally fit over the upper section 104 of the bit body 102. When so fitted, the sleeve's lower edge 120 is supported by the ledge 112 on the lower section 104 of the bit body 102. The upper section 122 further includes a ledge 124 that extends inward, as best shown in FIG. 3. The upper section 104 has a tip whose design consists of one of a variety of bit designs such as a Phillips head 134 or a flat blade head (not shown).

The magnetic-conductive tool bit gripping disc 126 has a center bore 128 and an outward edge 130 that extends beyond the vertical plane of the non magnetic-conductive housing 12. In the preferred embodiment, the disc 126 has a serrated edge 132 to facilitate the gripping of the disc when the tool bit 100 is being removed from housing 12. The bore 128 is dimensioned to frictionally fit into the upper section 122 and rests upon the inward extending ledge 124 of the sleeve 116, as shown in FIG. 2.

Figure 6:
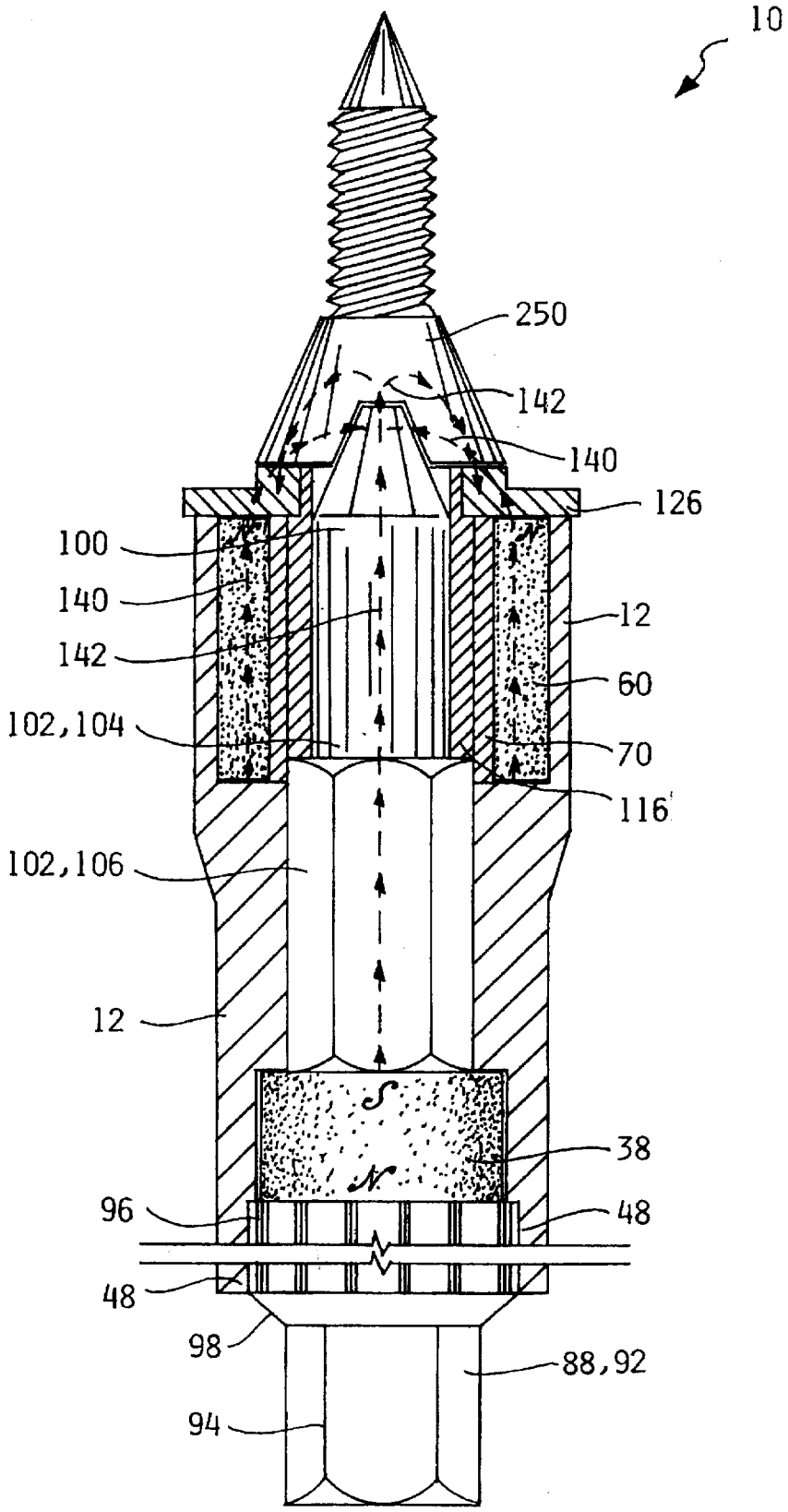
FIG. 6 is a partial elevational-sectional view showing the magnetic flow paths of the ring and circular magnet.

As previously stated, the composite magnetic-field screwdriver 10 functions in combination with the ring magnet 60 and the circular magnet 84. The two magnets produce a composite magnetic flux path consisting of a first magnetic flux path 140 and a second magnetic flux path 142, as shown in FIG. 6. The composite magnetic flux path is activated only when a workpiece 250 is inserted into the tip of the magnetic-conductive tool bit 100 which has previously been inserted into the tool bit cavity 80 with the lower surface 107 of the tool bit body 102 interfacing with the upper surface 86 of the circular magnet 84. When so inserted, the workpiece functions as a "magnetic connector" which allows the two magnetic flux path 140, 142 to combine and produce a high-level gauss at the tool bit tip and the gripping disc 126 which firmly holds the workpiece 250. The first magnetic flux path 140 is channeled, in sequence, from the ring magnet 60, the magnetic-conductive bit gripping disc 126, the workpiece 250 and the magnetic-conductive tool bit 100; the second magnetic flux path 142 is channeled, in sequence, from the circular magnet 84, the magnetic-conductive tool bit 100, the workpiece 250 and the magnetic conductive bit gripping disc 126. Prior to the insertion of the workpiece, the tool bit as well the magnetic-conductive bit gripping disc have magnetic power but do not have the composite magnetic power that can only be applied when both the ring magnet 60 and circular magnet 84 are in the composite magnetic circuit.

The second embodiment of the composite magnetic-field screwdriver 10, as shown in FIGS. 7, 8, 9 and 10, is comprised of two major elements: a magnetic housing 150 and a tool bit 190.

Figure 7:
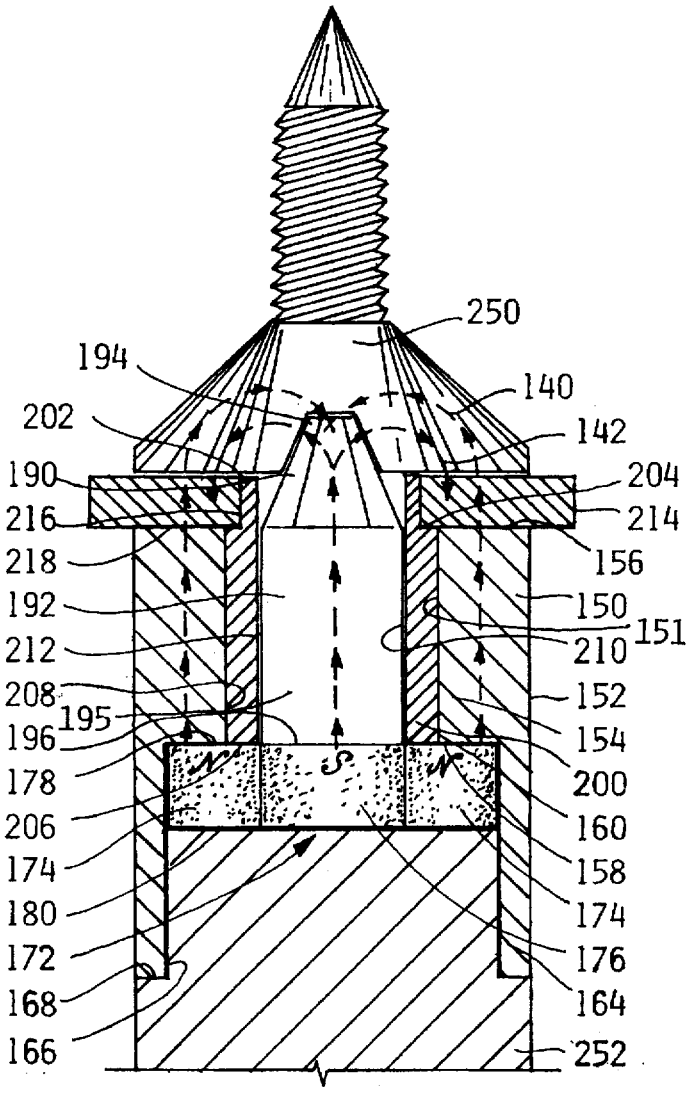
FIG. 7 is a partial elevational-sectional view of the second embodiment showing the magnetic housing with the magnetic-conductive tool bit. This figure also shows the magnetic flow paths of the concentric dual ring magnet.

The housing 150, as shown in FIG. 7, is made of a magnetic material and includes an inner surface 151, an outer surface 152, an upper sleeve 154 and a lower sleeve 164. The upper sleeve 154 has an upper edge 156, a lower outward stepped edge 158 and an inner polygon shaped surface 160.

The lower surface 164 which is contiguous with the upper surface 154 has an inward surface 166 that extends downward from the lower outward stepped edge 158 of the upper sleeve and terminates at a lower edge 168.

Figure 8:
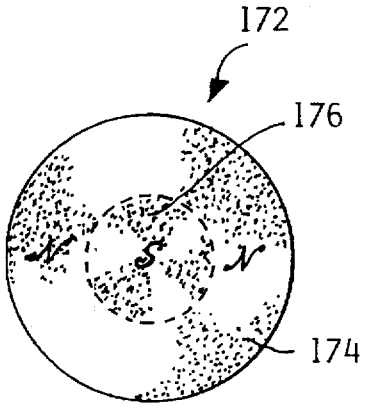
FIG. 8 is a plan view of the concentric dual ring magnet.

The second embodiment utilizes a concentric dual permanent magnet 172, as shown in FIGS. 7 and 8, that includes an outer section 174, an inner section 176, an upper surface 178 and a lower surface 180. The magnet 172 is preferably constructed, as shown in FIG. 8, with the outer section 174 interfacing with the inner section 176. However, as shown in FIG. 9, a magnetic insulating sleeve 182 may be located between the outer section 174 and the inner section 176.

Figure 9:
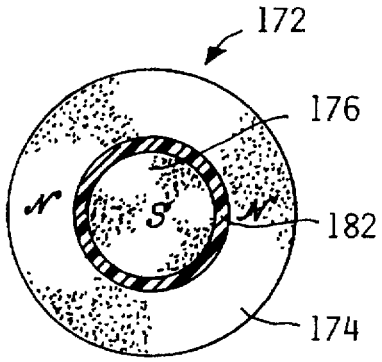
FIG. 9 is a plan view of a concentric dual ring magnet that includes a magnetic insulating sleeve between the magnet's inner and outer sections wherein each of the sections have opposite magnetic poles.

In either magnet design, the magnetic pole of the outer section 174 are opposite to those of the inner section 176 as shown in FIGS. 7–9. The magnet 172 is frictionally inserted into the lower sleeve 164 with the magnet's upper surface 178 pressed against the lower outward stepped edge 158 of the upper sleeve 154.

Figure 10:
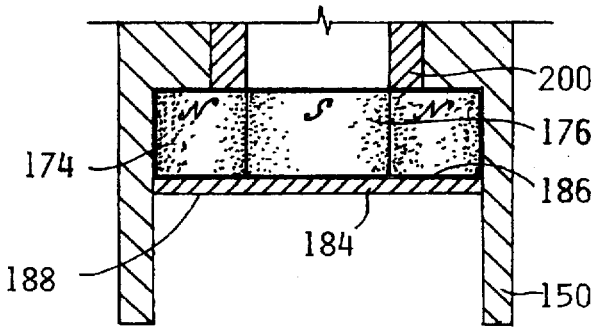
FIG. 10 is a partial elevational-sectional view of the second embodiment showing a non-magnetic disc placed between the lower surface of the concentric dual magnet and an upper surface of a screwdriver shaft.

As shown in FIG. 10, the second embodiment of the screwdriver 10 may include a non-magnetic disc 184 that includes an upper surface 186 and a lower surface 188. The disc 184 is inserted into the lower sleeve 164 with its upper surface 186 interfacing with the lower surface 180 of the concentric dual magnet 172. The disc 184 aids in maintaining the magnet in place and functions as a non-magnetic buffer when the lower sleeve 164 is inserted over a serrated shaft 252 of a hand-held screwdriver.

The second element that comprises the composite magnetic field screwdriver 10 is the tool bit 190 which is shown inserted into the upper sleeve 154 in FIG. 7. The tool bit 190 consists of a magnetic-conductive bit body 192, a non magnetic-conductive sleeve 200, and a magnetic-conductive tool bit gripping disc 214.

The bit body 172 includes an upper section 194 integral with a lower section 195 further having a lower surface 196. The bit body 192 has an outer diameter dimensioned so, that when the tool bit 190 is inserted into the upper sleeve 154, its lower surface 196 interfaces with the upper surface 178 of the inner section of the magnet 172.

The non magnetic-conductive sleeve 200 bas an upper section 202 further having an outward facing ledge 204, a bottom edge 206, an outer polygon surface 208 and an inner longitudinally serrated surface 210 that is dimensioned to interlock with a complimentary serrated surface 212 on the bit body 192. The outer polygon surface 208 of the sleeve 200 is dimensioned to slidably fit into the inner polygon surface 160 of the magnetic housing 150.

The magnetic-conductive tool bit gripping disc 214 as also shown in FIG. 7, includes a center bore 216 and a lower surface 218. The center bore 216 is dimensioned to frictionally fit over and be attached to the ledge 204 on the non magnetic conductive sleeve 200. The disc's lower surface 218 interfaces with the upper edge 156 of the upper sleeve 154 of the magnetic housing 150.

The concentric dual magnet 172 produces a composite magnetic flux path. The flux path is activated when a workpiece 250 is inserted over the upper end 194 of the tool bit 190 and the sleeve 200 which are inserted into the upper sleeve 154. The composite magnetic flux path results in a high-level gauss that firmly holds the workpiece 250 to the tool bit 190 and the gripping disc 214.

The composite magnetic flux path, as shown in FIG. 7, comprises a first magnetic flux path 140 and a second magnetic flux path 142. The first magnetic flux path 140 is channeled, in sequence, from the water section 174 of the concentric dual magnet 172, the magnetic housing 150, the magnetic-conductive bit gripping disc 214, the workpiece 250 and the magnetic-conductive tool bit 190. The second magnetic flux path 142 is channeled, in sequence, from the inner section 176 of the concentric dual magnet 172, the magnetic-conductive tool bit 190 and the workpiece 250 and the tool bit gripping disc 214.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A composite magnetic-field screwdriver comprising:

a) a non magnetic-conductive housing having:

(1) an upper sleeve, a polygon sleeve, a lower magnet sleeve and a drill chuck connector sleeve, (2) a ring magnet having an outer surface and an inner surface, wherein said ring magnet is inserted into the upper sleeve with the outer surface of said ring magnet interfacing with the upper sleeve, (3) an upper non magnetic-conductive sleeve inserted into said upper ring magnet wherein the area inward from said non magnetic-conductive sleeve forms a drill bit cavity, (4) a circular magnet frictionally inserted into the lower magnet sleeve, (5) a non magnetic-conductive drill chuck connector frictionally inserted into the drill chuck connector sleeve, and b) a magnetic-conductive tool bit comprising:

(1) a magnetic-conductive bit body having an upper section integral with a lower section that further having a lower surface, wherein the upper and lower sections are dimensioned to slidably fit into the tool bit cavity and the polygon sleeve respectively, with the lower surface interfacing with said circular magnet, (2) a non magnetic-conductive sleeve having an upper edge and an inside diameter dimensioned to surround the upper section of said tool bit, and (3) a magnetic-conductive tool-bit gripping disc having a center bore dimensioned to fit over and be attached to the upper edge of said non magnetic-conductive sleeve.

2. The screwdriver as specified in claim 1 wherein said ring magnet functions in combination with said circular magnet to produce a composite magnetic flux path that is activated when said tool bit is inserted into the tool bit cavity and a workpiece is attached to aid tool bit, wherein the composite magnetic flux path results in a high-level gauss that firmly holds the workpiece to said tool bit and said gripping disc.

3. The screwdriver as specified in claim 2 wherein the composite magnetic flux path comprises a first magnetic flux path and a second magnetic flux path, wherein the first magnetic flux path is channeled, in sequence, from said ring magnet, said magnetic-conductive tool-bit gripping disc, said workpiece and said magnetic-conductive tool bit, and wherein said second magnetic flux path is channeled, in sequence, from said circular magnet, said magnetic-conductive tool bit, said workpiece and said gripping disc.

4. The screwdriver as specified in claim 1 wherein said upper ring magnet and said circular magnet are comprised of a high magnetic-power material such as Samarium Cobalt or Neodimium.

5. The screwdriver as specified in claim 1 wherein said drill chuck connector has a lower section that is in a polygon shape.

6. A composite magnetic-field screwdriver comprising:

a) a non magnetic-conductive housing having:

(1) an upper sleeve having an upper edge, a lower terminus, and an inner surface, (2) a polygon sleeve having an upper terminus, a lower terminus and an inner surface, wherein the upper terminus interfaces with the lower terminus of said upper sleeve and the inner surface extends inward from a vertical plane of the inner surface of said upper sleeve, to form a magnet/sleeve ledge, (3) a lower magnet sleeve having an upper terminus, a lower terminus and an inner surface, wherein the upper terminus interfaces with the lower terminus of said polygon sleeve and the inner surface extends outward from the vertical plane of the inner surface of said polygon sleeve, and (4) a drill-chuck connector sleeve having a lower edge, an upper terminus and an inner surface, wherein the upper terminus interfaces with the lower terminus of said lower magnet sleeve and the inner surface extends outward from the vertical plane of the inner surface of said lower magnet sleeve, b) a ring magnet having an outer surface, an inner surface, an upper surface, and a lower surface, wherein said ring magnet is frictionally inserted into the upper sleeve with the outer surface interfacing with the inner surface of said upper sleeve, the upper surface in horizontal alignment with the upper surface of said upper sleeve and the lower surface resting on the magnet/sleeve ledge, c) an upper non magnetic-conductive sleeve having an outer surface, an inner surface, an upper edge, and a lower edge, wherein said sleeve is frictionally inserted into said ring magnet, with the upper edge of said sleeve in horizontal alignment with the upper edge of said ring magnet and with the lower edge of said sleeve resting on the magnet/sleeve ledge and wherein between the inner surface of said sleeve is formed a tool-bit cavity, d) a circular magnet dimensioned to frictionally fit into and within the confines of said lower magnet sleeve, e) a non magnetic-conductive drill-chuck connector having an upper section and a lower section, wherein the upper section of said non magnetic-conductive drill-chuck connector is dimensioned to frictionally fit into and within the confines of said drill-chuck connector sleeve, and wherein the lower section has a polygon shape that extends outward from the lower edge of said drill-chuck connector sleeve, and f) a tool bit comprising:

(1) a magnetic-conductive bit body having an upper section and an integral lower section, wherein the lower section has a lower surface, an upper terminus and a polygon shape dimensioned to slidably fit sequentially into said tool bit cavity and said polygon sleeve with the lower surface of the tool bit body interfacing with the upper surface of said circular magnet and wherein the upper section of said bit body has a diameter that is less than the diameter of the lower section such that a ledge is formed around the upper edge of the upper terminus, (2) a non magnetic-conductive sleeve having an upper edge, a lower edge, an upper section, and an inward extending ledge, wherein said sleeve is dimensioned to frictionally fit over the upper section of said bit body with the lower edge resting against the ledge on said lower section of said bit body, and (3) a magnetic-conductive, tool-bit gripping disc having a center bore and outward edges that extend beyond the vertical plane of said non magnetic-conductive housing, wherein said bore is dimensioned to frictionally fit into the upper section of said non magnetic-conductive sleeve and rest upon the inward extending ledge on said non magnetic-conductive sleeve, wherein said ring magnet functions in combination with said circular magnet to produce a composite magnetic flux path that is activated when said tool bit is inserted into the tool bit cavity and a workpiece is attached to said tool bit, wherein the composite magnetic flux results in a high-level gauss that firmly holds the workpiece to said tool bit and said gripping disc.

7. The screwdriver as specified in claim 6 wherein the composite magnetic flux path comprises a first magnetic flux path and a second magnetic flux path, wherein the first magnetic flux path is channeled, in sequence, from said ring magnet, said magnetic-conductive bit gripping disc, said workpiece and said magnetic-conductive tool bit, and wherein said second magnetic flux path is channeled, in sequence, from said circular magnet, said magnetic-conductive tool bit and said workpiece.

8. The screwdriver as specified in claim 6 wherein said polygon sleeve is in a hexagon shape.

9. The screwdriver as specified in claim 6 wherein said upper ring magnet and said circular magnet are comprised of a high magnetic-power material such as Samarium Cobalt or Neodimium.

10. The screwdriver as specified in claim 6 wherein the polygon shape of said drill chuck connector is in a hexagon shape.

11. The screwdriver as specified in claim 6 wherein the upper section of said drill chuck connector further comprises a plurality of longitudinal serrations.

12. The screwdriver as specified in claim 6 wherein said upper non magnetic-conductive sleeve is made of stainless steel.

13. The screwdriver as specified in claim 6 wherein said circular bit-gripping disc further comprises a serrated edge.

14. A composite magnetic-field screwdriver comprising:

a) a magnetic housing having:

(1) an outer inner surface and an surface, (2) an upper sleeve having an upper edge, a lower outward stepped edge, and an inner polygon shaped surface, (3) a contiguous lower sleeve having an inward surface that extends downward from the lower outward stepped edge of the upper sleeve and terminates at a lower edge, (4) a concentric dual magnet having an outer section, an inner section, an upper surface and a lower surface, wherein the magnetic poles of the outer section are opposite to those of the inner section, wherein said magnet is frictionally inserted into the lower sleeve with the upper surface of the outer section said magnet pressed against the lower outward stepped edge of the upper sleeve, b) a tool bit comprising:

(1) a magnetic-conductive bit body having an upper section integral with a lower section further having a lower surface, wherein said bit body has an outer diameter dimensioned, so that when said tool bit in inserted into the upper sleeve, the lower surface of said tool bit body interfaces with the upper surface of the inner section of said magnet, (2) a non magnetic-conductive sleeve having an upper section, further having an outward facing ledge, a bottom edge, an outer polygon surface and an inner longitudinally serrated surface dimensioned to interlock with a complimentary serrated surface on said bit body, wherein the outer polygon surface is dimensioned to slidably fit into the inner polygon surface on the upper sleeve of said magnetic housing, and (3) a magnetic-conductive tool bit gripping disc having a center bore and a lower surface, wherein the center bore is dimensioned to frictionally fit over and be attached to the ledge on said non magnetic-conductive sleeve and with its lower surface interfacing with the upper edge on the upper sleeve of said magnetic housing.

15. The screwdriver as specified in claim 14 wherein said composite dual-ring magnet produces a composite magnetic flux path that is activated when a workpiece is inserted into the upper end of said tool bit and said tool bit is inserted into said upper sleeve, wherein the composite magnetic flux path results in a high-level gauss that firmly holds the workpiece to said tool bit and said tool bit gripping disc.

16. The screwdriver as specified in claim 15 wherein the composite magnetic flux path comprises a first magnetic flux path and a second magnetic flux path, wherein the first magnetic flux path is channeled, in sequence, from the outer section of said concentric dual magnet, said magnetic housing, said magnetic-conductive bit gripping disc, said workpiece and said magnetic-conductive tool bit, and wherein said second magnetic flux path is channeled, in sequence, from the inner section of said concentric dual magnet, said magnetic-conductive tool bit, said workpiece and said tool bit gripping disc.

17. The screwdriver as specified in claim 14 further comprising a non-magnetic disc having an upper surface and a lower surface, wherein said non-magnetic disc is inserted into the lower sleeve with the upper surface of said non-magnetic disc interfacing with the lower surface of said concentric dual magnet wherein said disc aids in maintaining said magnet in place and functions as a buffer when the lower sleeve is inserted over a shaft of a hand-held screwdriver.

* * * * *